US005105740A

United States Patent [19]

Loos et al.

[11] Patent Number: 5,105,740

[45] Date of Patent: Apr. 21, 1992

[54] WASHING DEVICE FORMED AS AN INSERT UNIT

[75] Inventors: Gerhard Loos, Horrenberg; Nikolaus Spiegel, Walldorf, both of Fed. Rep. of Germany

[73] Assignee: Heidelberger Druckmaschinen AG, Heidelberg, Fed. Rep. of Germany

[21] Appl. No.: 496,426

[22] Filed: Mar. 20, 1990

[30] Foreign Application Priority Data

Mar. 20, 1989 [DE] Fed. Rep. of Germany ..... 3909119

[51] Int. Cl.[5] ..... B41L 41/00; B41F 35/00

[52] U.S. Cl. ..... 101/425; 101/423; 101/424

[58] Field of Search ..... 101/423, 424, 424.1, 101/425; 15/256.52

[56] References Cited

U.S. PATENT DOCUMENTS

| | | | |
|---|---|---|---|
| 4,555,989 | 12/1985 | Marass et al. | 101/424 |
| 4,651,644 | 3/1987 | Kaempfe et al. | 101/423 |
| 4,757,763 | 7/1988 | MacPhee et al. | 101/425 |
| 4,981,078 | 1/1991 | Dettinger et al. | 101/425 |

FOREIGN PATENT DOCUMENTS

| | | | |
|---|---|---|---|
| 1525255 | 9/1978 | United Kingdom | 101/425 |
| 1575686 | 9/1980 | United Kingdom . | |
| 2222552 | 3/1990 | United Kingdom | 101/425 |

*Primary Examiner*—Edgar S. Burr
*Assistant Examiner*—Joseph R. Keating
*Attorney, Agent, or Firm*—Herbert L. Lerner; Laurence A. Greenberg

[57] ABSTRACT

A washing device formed as an insert unit on a printing machine for cleaning the outer cylindrical surface of rollers or cylinders includes a washcloth supply roll and a dirty-washcloth take-up roll for a washcloth, a device for saturating the washcloth with washing medium, a device for withdrawing the washcloth from the supply roll by winding the washing device on the take-up roll via an actuable pressure applicator, so that, during a washing operation, the pressure applicator presses the washcloth against a roller or cylinder, the take-up roll being connectible with a feeder device fixed to the machine, the washing device being automatically connectible with a roll-sensing device fixed to the machine when it is slid as an insert unit into position in the machine, an upwardly exposed washcloth section, in the slid-in position, being disposed upstream of a membrane member, as viewed in transport direction of the washcloth, the washcloth section being located beneath a washing-medium dispenser device fixed to the machine and extending along an elongated side of the washing device.

10 Claims, 8 Drawing Sheets

WASHING DEVICE FORMED AS AN INSERT UNIT

The invention relates to a washing device for a printing machine and, more particular, to a washing device as an insert unit for cleaning the outer cylindrical surface of a roller or cylinder of a printing machine, such as a rubber blanket of a blanket cylinder. The insert unit is formed as a slide-in element.

The washing device is held in position by sliding it into a holder formed on the machine frame of the printing machine. Furthermore, the washing device includes a washcloth supply roll and a dirty-cloth take-up roll, the washcloth being saturatable with washing liquid. The dirty-cloth roll is connectible to a transporting or conveying device. By winding the washcloth on the dirty-cloth take-up roll, the washcloth is unwound from the supply roll. The washcloth passes over a pressure applicator, which is selectively actuable, for example pneumatically, so as to bring the washcloth into contact with a cylinder or roller such as the rubber blanket of a blanket cylinder to be cleaned.

The basic construction of such a washing device has become known heretofore from German Patent 29 38 671, for example. Furthermore, the aforementioned pneumatically actuable pressure applicator is known in practice. In such a conventional washing device, however, the insertion or sliding-in of the washing device into the holder on the machine frame provides a connection only between the feeder device and the dirty-cloth take-up roll. It is then also necessary, besides a pneumatic-line connection, to provide a connection for separate lines for water and detergent to the washing device in order to wet the washcloth suitably by means of a spraying device located in the washing device. It may also be necessary or desirable to provide a separate connection in order to detect the condition of the roll. This is associated with a handling effort or expense on the part of the user which is felt to be disruptive. In addition, the necessary connection points for the inlet and outlet lines ma themselves be sources of trouble.

With regard to the aforedescribed prior art, it is an object of the invention to provide a washing device for a printing press which is in the form of an insert unit or slide-in element which is as simple and reliable to operate as possible and is relatively easy to handle.

With the foregoing and other objects in view, there is provided, in accordance with the invention, a washing device formed as an insert unit on a printing machine for cleaning the outer cylindrical surface of rollers or cylinders, comprising a washcloth supply roll and a dirty-washcloth take-up roll for a washcloth, means for saturating the washcloth with washing medium, means for withdrawing the washcloth from the supply roll by winding it on the take-up roll via an actuable pressure applicator, so that, during a washing operation, the pressure applicator presses the washcloth against a roller or cylinder, the take-up roll being connectible with a feeder device fixed to the machine, the washing device being automatically connectible with a roll-sensing device fixed to the machine when the washing device is slid as an insert unit into position in the machine, an upwardly exposed washcloth section, in the slid-in position, being disposed upstream of a membrane member, as viewed in transport direction of the washcloth, the washcloth section being located beneath a washing-medium dispenser device fixed to the machine and extending along an elongated side of the washing device.

According to the invention, as a result of or in the process of the washing device being inserted or slid into the holder on the machine frame, the washing device is automatically mechanically connectible to a roll-sensing device, fixed to the machine. It is not necessary to establish an electrical connection. After the washing device has been slid into position, a connection to the roll-sensing device is made. The invention provides further that, in the slid-in position, the upwardly exposed washcloth section disposed upstream of the pressure applicator or the membrane member, as viewed in the conveying or transport direction of the washcloth, is located beneath a washing-medium dispensing device fixed to the machine and extending along an elongated side of the washing device. The washing-medium or detergent dispensing device is separate from the slide-in element. It is fixed to the printing machine, that is, it remains in the machine when the washing device is removed. Due to the fact that the washing medium dispensing device is disposed above the washing device per se and is assigned to an exposed section of the washcloth, it is possible for the washing-medium or liquid to drip from above onto the washcloth. Spraying or the like is not necessarily required. Nor are electrical connections to the washing device required with regard to the wetting or dampening of the washcloth with washing liquid. Surprisingly, due to the construction according to the invention, the washing device itself may be without any electrical units, electrical lines, and so forth. Such components which, because of the possibility of flooding by washing liquid, require special protection or otherwise may cause malfunctions, are still provided only in devices which are fixed to the machine.

The construction according to the invention also has a further marked advantage that the washing device is of considerably simpler construction than heretofore, because the entire device for respectively wetting and spraying the washcloth with washing liquid is no longer built into the washing device. The washing device thereby has become, for example, lighter and, to that extent, likewise easier to handle. If the washing device is correctly inserted or slid into position, the assignment to the washing-medium dispensing device and the connection to the roll-sensing device are automatically accomplished.

Preferably, the washing device is connectible to a feeder device for the washcloth by means of a coupling claw which projects from the side cover of the washing device. The side cover is a side part of the washing device which is assigned to the machine frame. The washing device, as a whole, can be held by and fastened to the machine frame of the printing machine by means of a rail guide. In this regard, the invention further provides that on the side cover of the washing device, at least two fastening bolts are provided, which are disposed in such a manner that an imaginary connecting line between the fastening bolts is located beyond, i.e., to the outside, and preferably below the coupling claw. The fastening bolts are spaced apart in the slide-in direction of the insert unit or slide-in element. At least one of the fastening bolts is insertible into the rail guide fixed to the machine. Furthermore, one of the fastening bolts is in the form of a latching bolt which is latchable in a holder fixed to the machine. The arrangement of the fastening bolts in the afore-described manner promotes the advantageous handling of the washing device. Furthermore, the spacing of the fastening bolts in the slide-in direction provides a reliable two-point mounting, while maintaining a simple construction.

In a further embodiment of the invention, the front fastening bolt, which is disposed in the vicinity of the pressure applicator of the washing device, is of rigid construction. It is merely a guide bolt, which is inserted into the rail guide, and is form-lockingly or positively held therein.

The rear fixing bolt, which is constructed as a latching bolt, is movable into a locking position and into an unlocking position preferably by means of a spring-biased cam lever. The indexing position is stable both in the unlocking position, as well as in the locking position. When the washing device is slid into position, initially the two front fastening bolts (one on each side cover of the washing device) are inserted into the rail guides fixed to the machine, and the washing device is then slid forward. The washing apparatus can be swivelled about the front fastening bolts, which act, as it were, as a swivel axis, until the rear fastening bolts are at the level of corresponding latching recesses formed in the holder fixed to the machine. The latching bolts can then be extended, for example, by means of the aforementioned cam lever, and latching can thereby be effected. For this purpose, provision has been made that, in the slid-in position, the latching bolts are disposed outside the rail guide or the rail guide is only of such a length that, with the washing device in the slid-in position, the latching bolts are not in the rail guide.

According to a further teaching of the invention, the coupling claw of the washing device forms a claw holding fixture which is open in the slide-in direction. In the inserted or slid-in condition, a drive pin of the feeder device for the washcloth is form-lockingly or positively accommodated in the claw holding fixture. Due to the fact that the claw holding fixture is open in the slide-in direction, the positive or form-locking connection to the drive pin of the feeder device is effected in a relatively simple manner when the slide-in device is slid into position. Preferably, the slide-in direction of the insert unit or slide-in element extends more or less radially with respect to the cylinder or roller, such as the blanket cylinder, against which the washcloth can then be pressed, if necessary, for cleaning.

With regard to the roll-sensing device, according to the invention, it is formed of a proximity switch, which is disposed on the machine frame of the printing machine laterally with respect to the washcloth roll of the washing device. The proximity switch responds to the positioning or adjusting movement of the roll-sensing device. More specifically, the roll-sensing device has a transmission shaft which passes through the side cover of the washing device. Attached to the transmission shaft at one end is a roll feeler, which mechanically detects the thickness of the washcloth roll. A positioning or adjusting movement of the roll feeler, caused by a change in the thickness of the washcloth roll results in a rotary movement of the transmission shaft. The rotary movement, due to a suitable conversion or transformation, is detected by the proximity switch, as is explained hereinafter in further detail. The roll feeler itself is preferably formed of a feeling or sensing element, for example a feeling plate, which is held in spring-biased manner on the transmission shaft and which is in contact with the roll. The roll feeler is assigned to the supply roll. As the thickness of the roll decreases, the transmission shaft performs a rotary movement in accordance with the angular movement of the roll feeler. At the machine-frame end, the transmission shaft has a contact cam which cooperates with a swivel element spring-biased against the contact cam. The proximity switch detects a swiveling-away of the swivel element. The swivel element is of such construction that, at a defined swivel angle, a rapid swiveling-away of the swivel element from the proximity switch occurs. For example, the swivel element may, for this purpose, also be of stepped construction. The switching pulse of the proximity switch is then converted or transformed into the message: Spool empty.

Other features which are considered as characteristic for the invention are set forth in the appended claims.

Although the invention is illustrated and described herein as embodied in a washing device formed as an insert unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Illustrated and described herein is a washing device for a printing machine, the latter, however, not being represented in detail.

Figure 1:
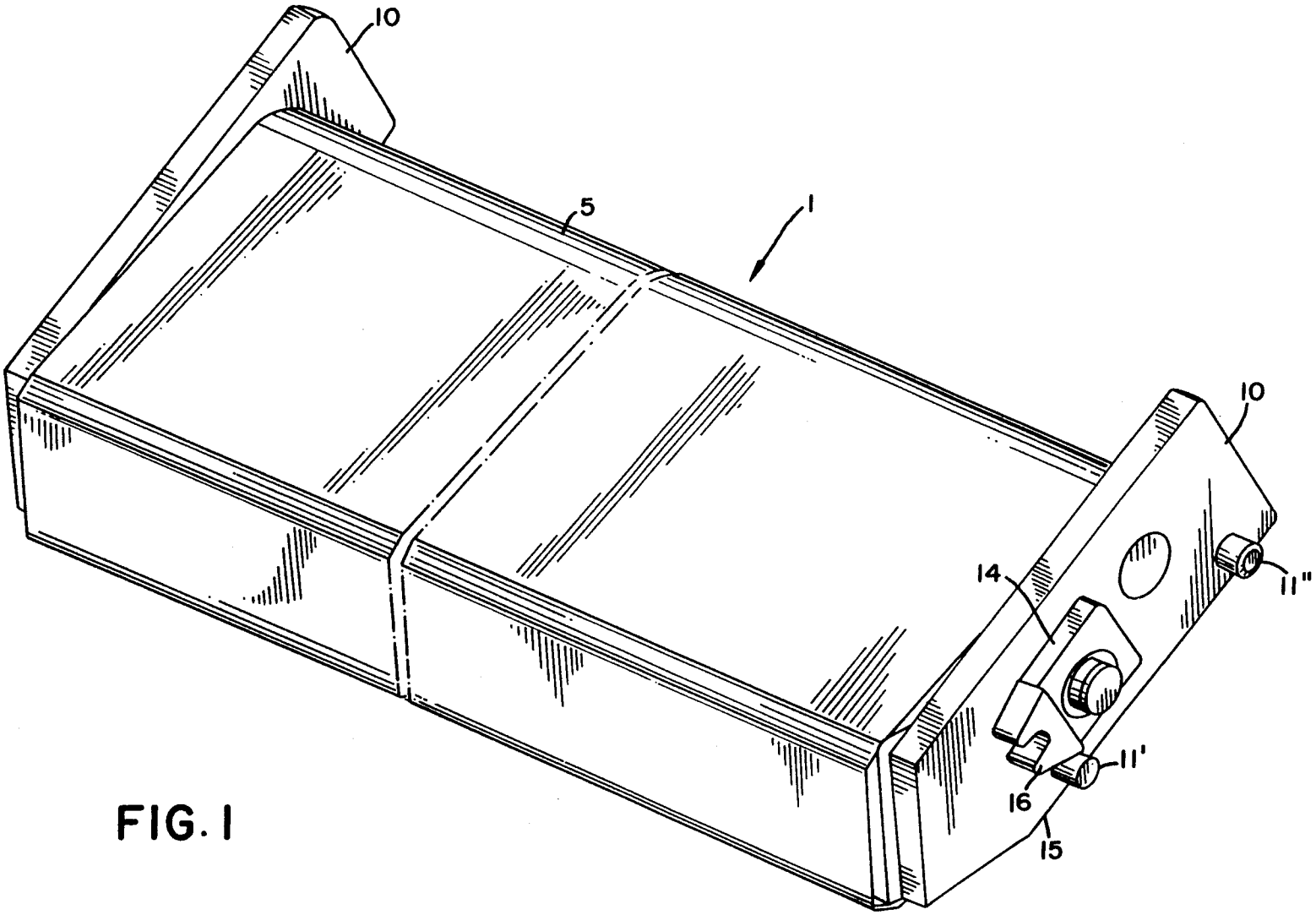
FIG. 1 is a perspective view of the washing device according to the invention which has been removed from the printing machine.
Figure 2:
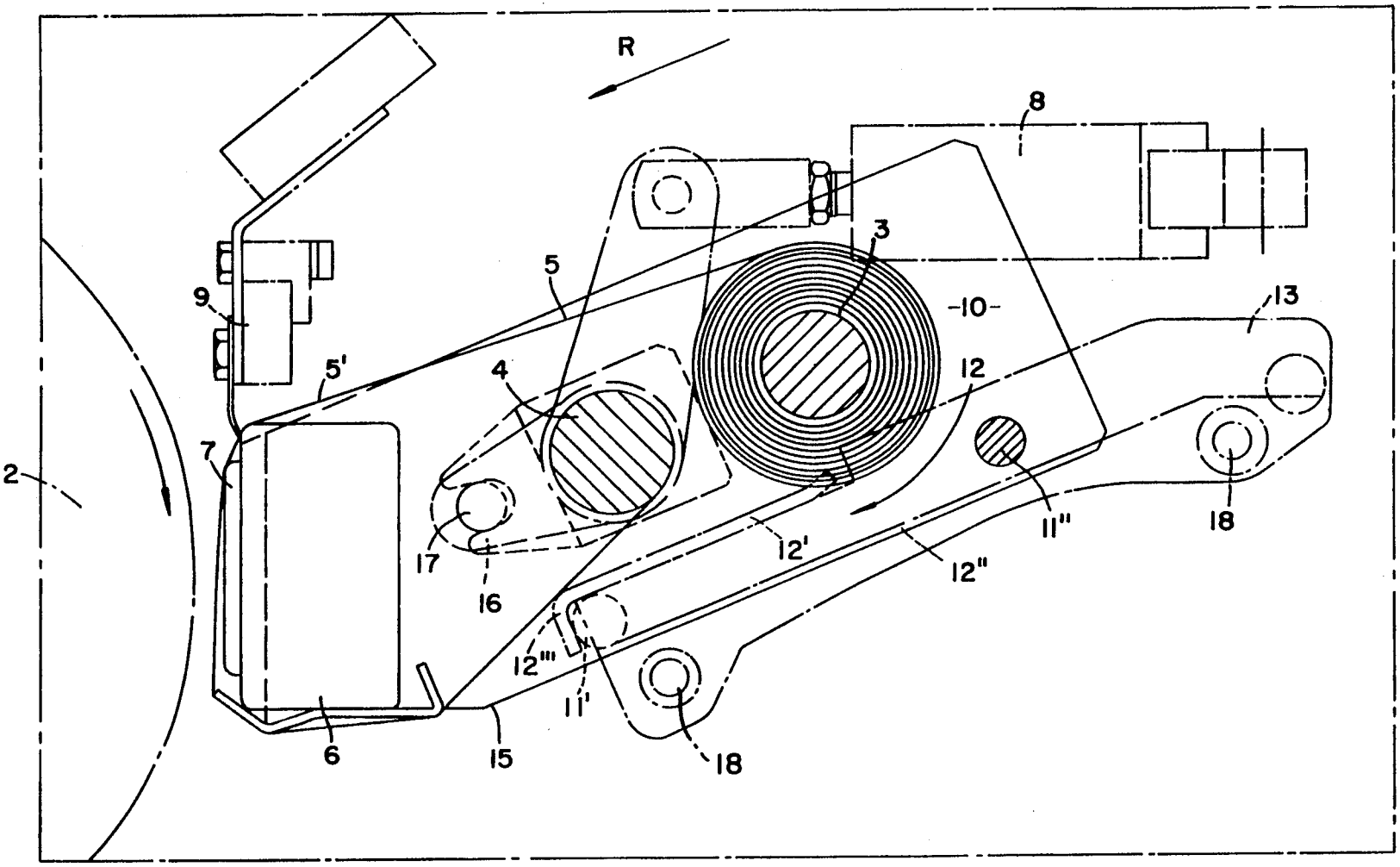
FIG. 2 is a side elevational view of the washing device, with the components thereof which are fixed to the machine being shown in phantom.

Referring now to the drawing and, first, particularly to FIGS. 1 and 2 thereof, there is shown a washing device 1, which, in its built-in condition, is in the form of an insert unit or slide-in element, and is assigned to a blanket cylinder 2 of the printing machine. The washing device 1 has a supply roll 3 for a washcloth, which, when soiled is wound on a soiled or dirty-cloth take-up roll 4. In the view shown in FIG. 2, the supply roll 3 is still virtually completely full, and only a few turns of the washcloth are wound on the dirty-cloth take-up roll 4. A membrane member 7 in a pressure-applying device 6 is inflatable. The washcloth 5 is thus able to be pressed against the blanket cylinder 2 so that a washing operation may be performed. The dirty-cloth take-up roll 4 is reversably actuable by means of a feeder device 8, for winding up the washcloth 5.

A washing-medium dispensing device 9, extending over the long side of the washing device 1, is disposed above an upwardly exposed washcloth section 5'.

The washing device 1 has two fastening bolts 11' and 11" on each of its two side covers 10. The fastening bolt 11' located towards the front end of the washing device 1 is inserted into a rail guide 12, which is formed on a holder 13 fixed to the machine. The rail guide 12 is formed of an upper, shorter rail 12' and a lower, longer rail 12". On the side facing the blanket cylinder 2, the upper rail 12' is bent so as to form a stop 12'''.

One of the fastening bolts, namely the rear fastening bolt 11", is formed as a latching bolt, as is explained hereinafter in greater detail.

Figure 4:
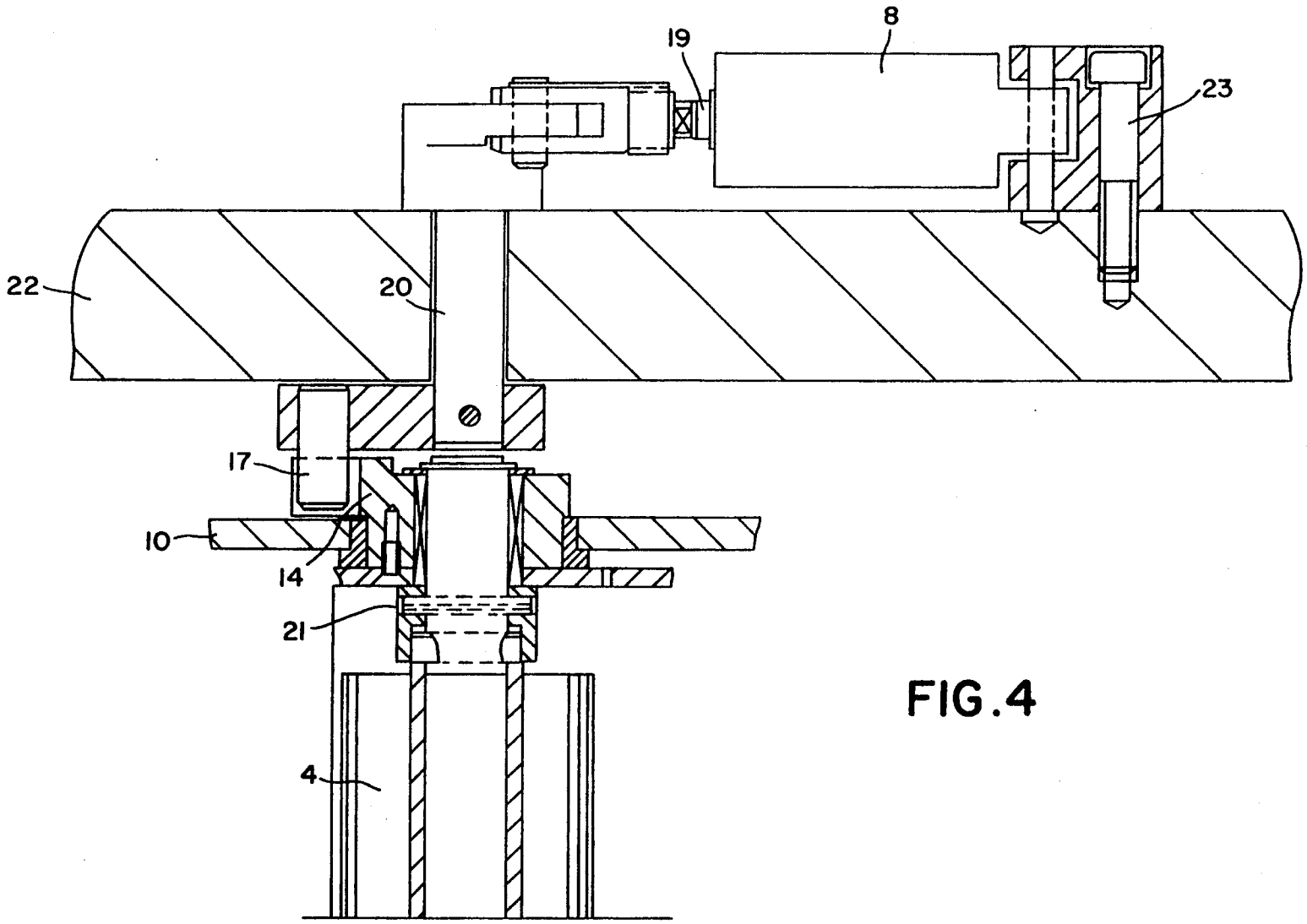
FIG. 4 is a fragmentary top plan view of the feeder device of FIG. 3 shown, in the connected position, with the dirty-cloth take-up roll.

As shown in FIG. 4, further provided on the side cover 10 of the washing device 1 is a projecting coupling claw 14, for connecting the shaft of the dirty-cloth take-up roll 4 to the feeder device 8. The two fastening bolts 11' and 11" are disposed on an imaginary connecting line situated outside of the coupling claw 14, a fact which may be ascertained from FIG. 1. In addition, in the illustrated embodiment, the fastening bolts 11' and 11" are disposed in the vicinity of a lower edge 15 of the washing device 1. Advantages relating to handling technique result therefrom during removal and installation of the roll 4, for example. The coupling claw 14 need not itself engage in a connecting link guide or the like. On the contrary, when the washing device 1 is being slid in, the coupling claw 14 automatically grips a drive pin 17 of the pneumatic feeder device 8 for the dirty-cloth take-up roll 4 in a positive or form-locking manner by means of the claw holding fixture 16, which is open in the slide-in direction represented by the arrow R.

The holder 13 is anchored firmly to the machine by means of diagrammatically indicated bolted connections 18.

Figure 3:
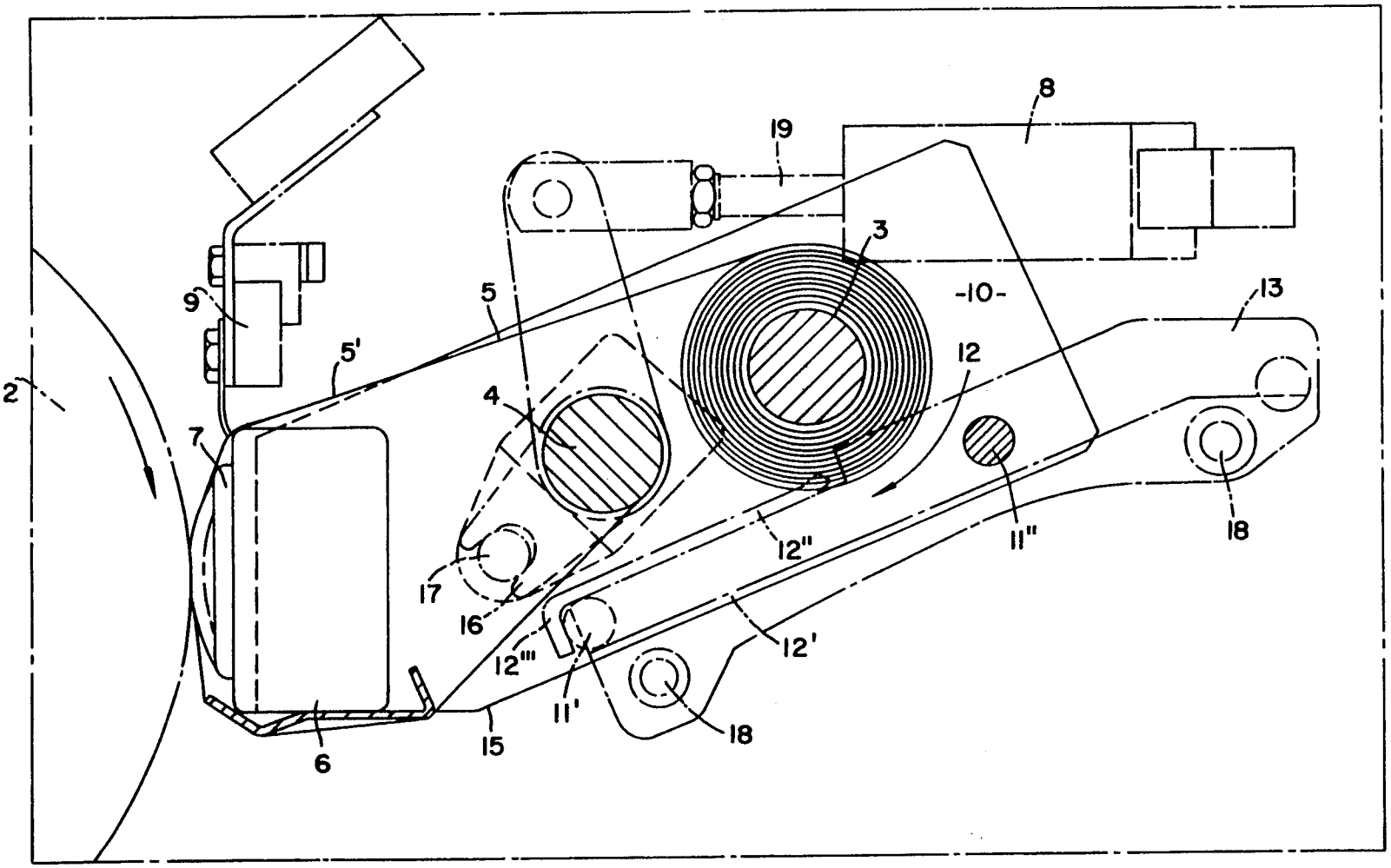
FIG. 3 is a view of the washing device like that of FIG. 2, wherein a feeder device for the dirty-cloth take-up roll is in an actuated condition.

FIG. 3 shows the feeder device 8 in its actuated state. The coupling claw 14 has been operated by means of a piston rod 19 through the intermediary of a drive shaft 20 (note FIG. 4) and the pin 17. A ratchet mechanism 21 or the like is incorporated within the drive of the shaft of the dirty-cloth take-up roll 4, with the result that the feeder device 8 is able to perform a return stroke while entraining the coupling claw 14 and without any unwinding of the washcloth 5. The restoring forces of the ratchet mechanism 21 are compensated. FIG. 4 further shows that the drive pin 17 is disposed between the side cover 10 of the washing device 1 and a longitudinal wall 22 of the printing machine. By mean of a shaft 20, the feed or thrust from the device 8 is transmitted through the side wall 22 of the printing machine. The feeder device 8, for example in the form of a pneumatic cylinder, is anchored by means of bolts 23 or the like in the side wall 22 of the printing machine.

Figure 5:
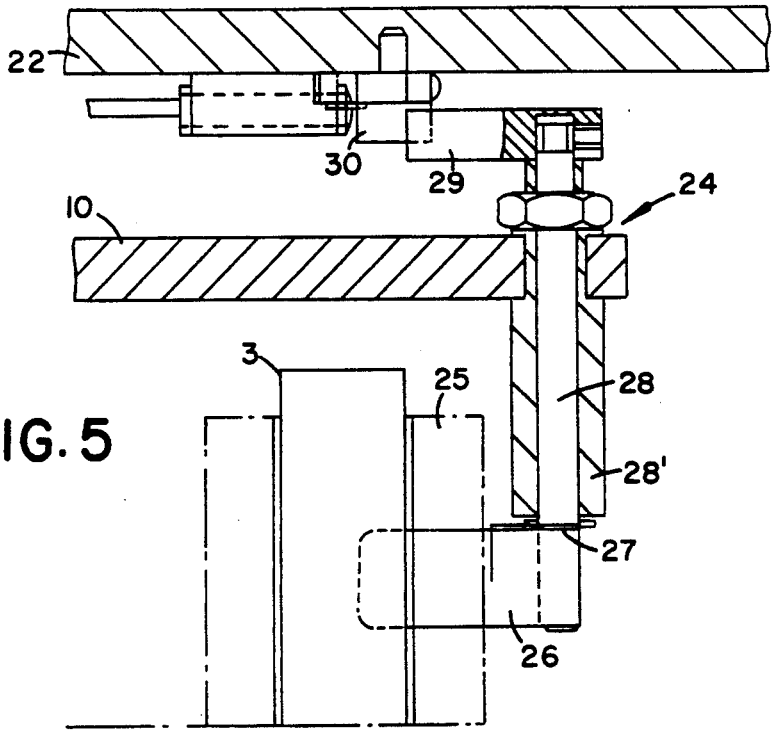
FIG. 5 is a fragmentary top plan view of FIG. 3 showing a roll sensing device.
Figure 6:
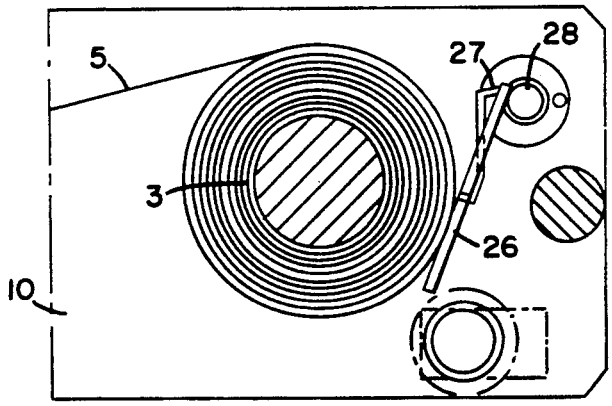
FIG. 6 is a side elevational view of FIG. 5 showing the roll sensing device in the washing device with a full supply roll.
Figure 7:
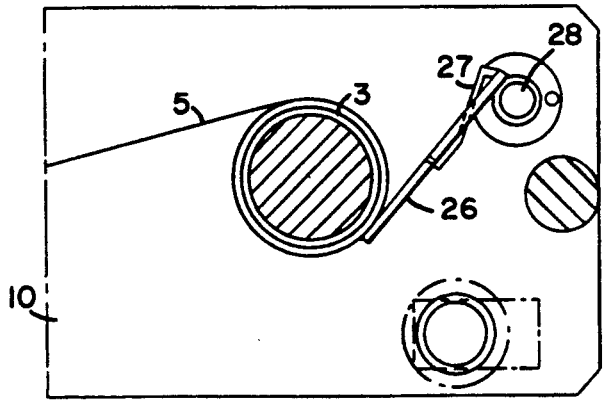
FIG. 7 is a view like that of FIG. 6 with the supply roll almost empty.
Figure 8:
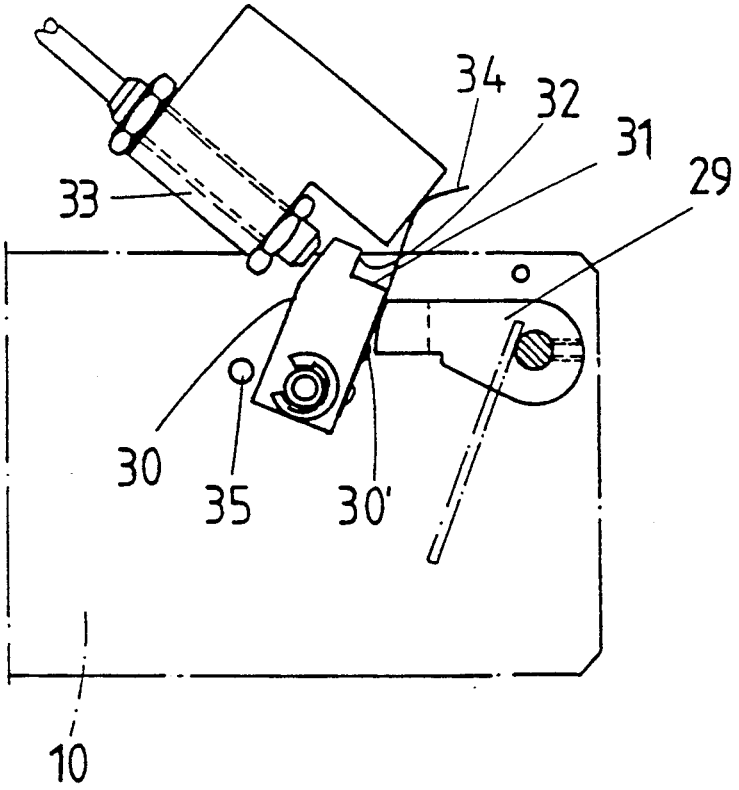
FIG. 8 is a fragmentary side elevational view of FIG. 5 showing a connection location between components of the roll-sensing device both on the side of the insert or slide-in element and on the side of the machine, with a full supply roll.
Figure 9:
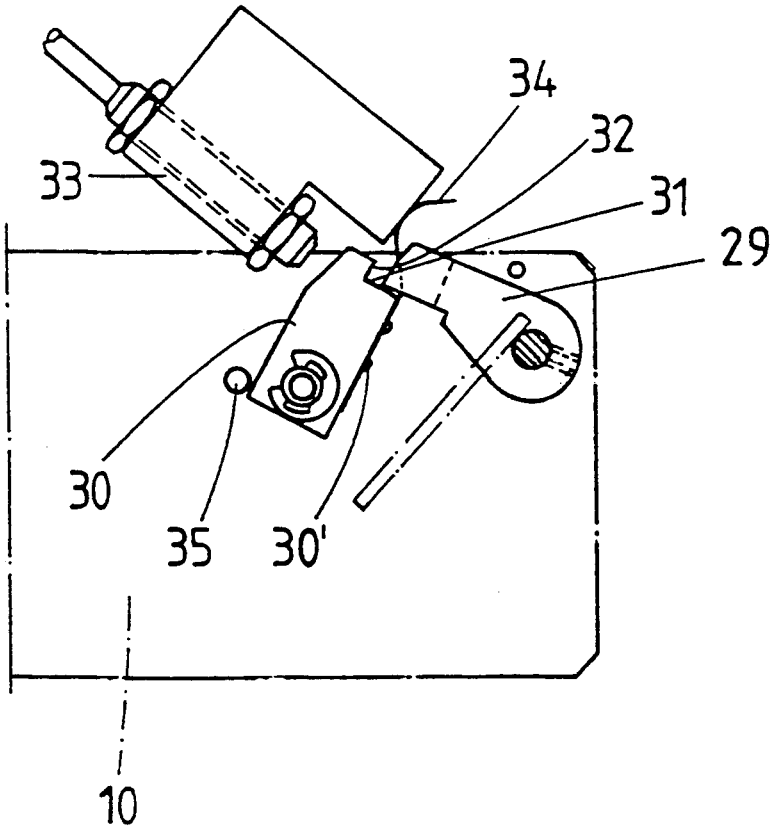
FIG. 9 is a view like that of FIG. 8, with the supply roll almost empty.

The supply roll 3 is shown merely diagrammatically in FIG. 5. The details of the roll-sensing device 24, which cooperates with the supply roll 3, are apparent from FIGS. 5 to 9.

The roll-sensing device 24 has a sensing plate 26, which rests on the roll or winding 25 of the supply roll 3 and is mounted on a transmission shaft 28. The sensing plate 26 is biased towards and against the supply roll 3 by means of a leg spring 27 which is braced against a sleeve 28' holding the transmission shaft 28 and anchored in the side wall 10 of the printing machine so as to be fixed against relative rotation with the shaft 28. The transmission shaft 28 transmits the adjusting movement of the sensing plate 26 to a contact cam 29. The contact cam 29 cooperates with a swivel element 30 (note also FIGS. 8 and 9). In the embodiment shown in FIGS. 8 and 9, the swivel element 30 has a step 31. With the supply roll 3 full, i.e., approximately in the condition existing when the washing device 1 is newly inserted into a printing machine, the contact cam 29 is more-or-less in the position shown in FIG. 8. When the washing device 1 is slid in i.e. inserted, the contact cam 29 moves against a broad side 30' of the swivel element 30. As the supply roll 3 increasingly unwinds, the contact cam 29 travels upwardly. After the contact cam 29 has reached the end or the step 31 of the swivel element 30, it assumes the position thereof shown in FIG. 9. The end face of the contact cam 29 is not in contact with the section 32 of the swivel element 30, however, because the swivel movement of the swivel element 30 wa already previously limited by the stop cam 35. The swivel element 30 is assigned to a proximity switch 33. When the contact cam 29 engages the step 31 (in the embodiment), the swivel element 30 moves away from the proximity switch 33 with corresponding abruptness. The proximity switch 33 thus emits a signal, which is transformed to "Supply roll empty". Furthermore, the swivel element 30 is biased towards and against the contact cam 29 by means of a leaf spring 34. In order, however, to ensure a reliable meeting of the contact cam 29 and the swivel element 30 during the slide-in, the swivel movement of the swivel element 30, as stated hereinabove, is limited by the stop cam 35.

Figure 10:
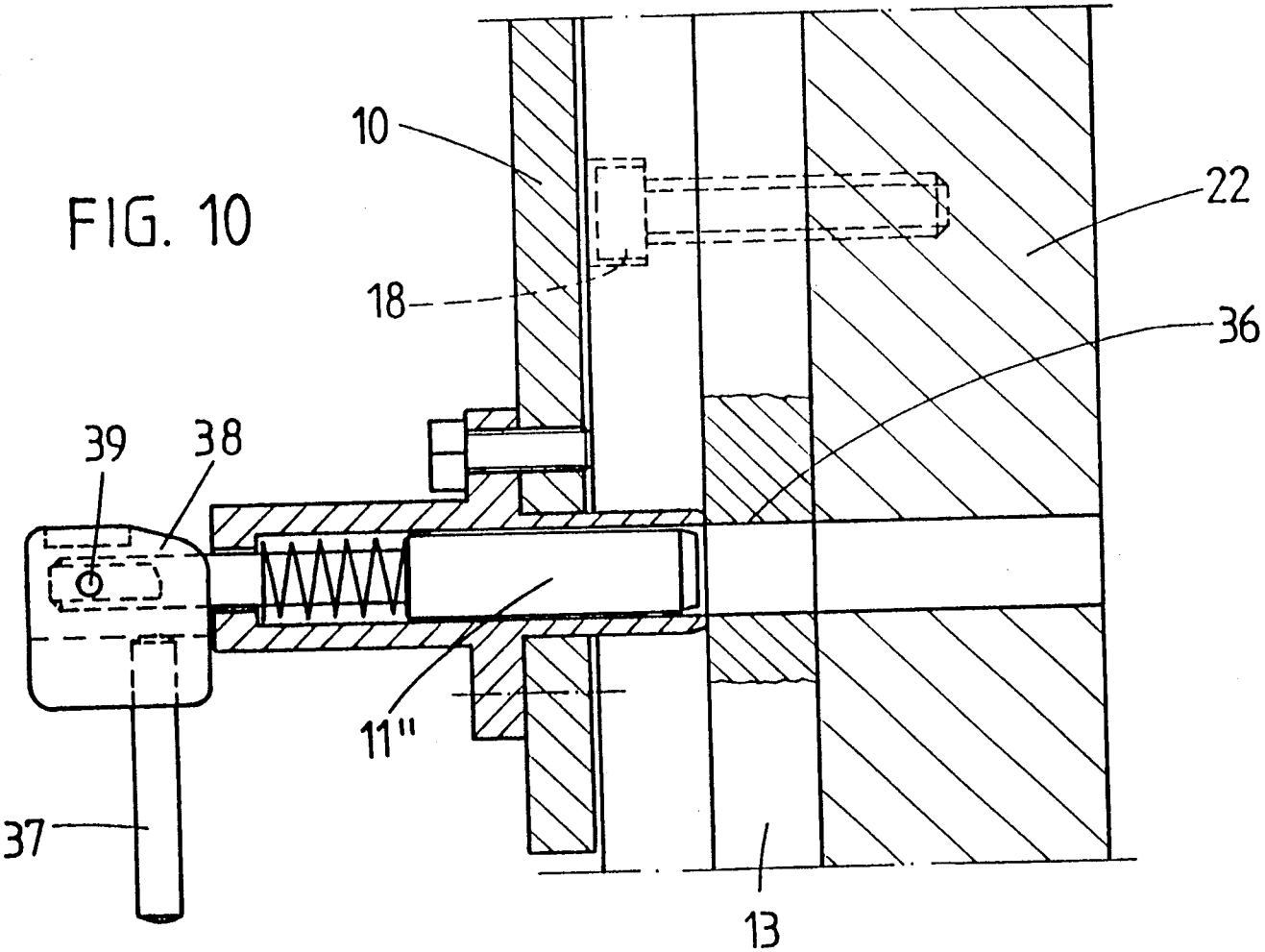
FIG. 10 is a fragmentary sectional view of the washing device showing a latching bolt thereof in unlocked position.
Figure 11:
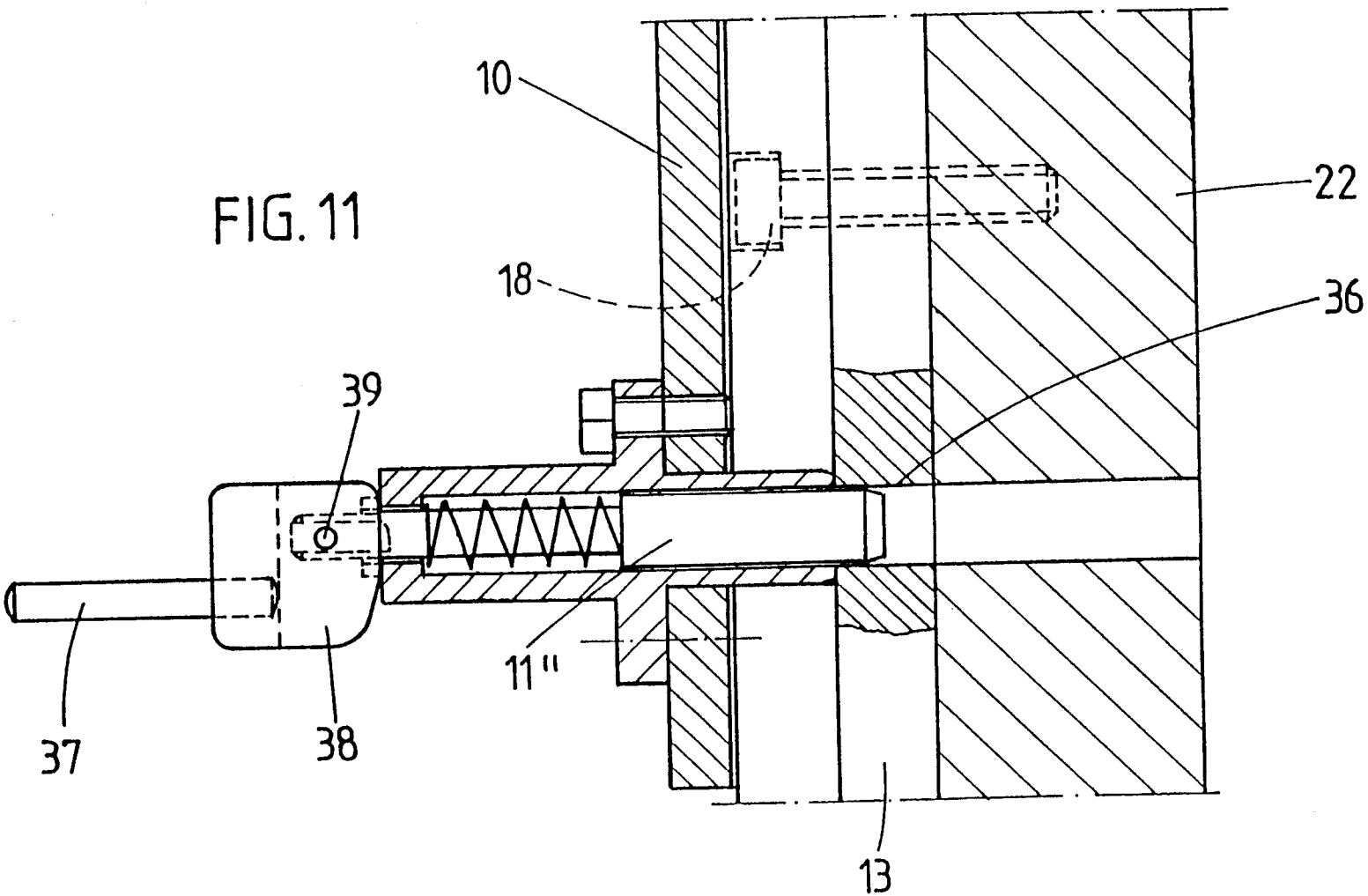
FIG. 11 is a view like that of FIG. 10 showing the latching bolt in locked position.

The latching bolt 11" is shown in greater detail in FIGS. 10 and 11. In FIG. 10, the latching bolt 11" is in the unlocked position. FIG. 11 shows it in the locked position. It is apparent that, in the view of FIG. 11, the latching bolt 11" has travelled into an index bore 36, which is stationary in the machine due to the holder 13 and which represents one of the aforementioned latching recesses.

An actuating lever 37 is connected to a cam element 38 which, in turn, is connected to the latching bolt 11" through the intermediary of an articulating joint 39. Due to the construction of the cam element 38, the unlocked and locked positions, respectively, are attainable when the lever 37 is thrown or shifted.

The foregoing is a description corresponding in substance to German Application P 39 09 119.8, dated March 20, 1989, the International priority of which is being claimed for the instant application, and which is hereby made part of this application. Any material discrepancies between the foregoing specification and the aforementioned corresponding German application are to be resolved in favor of the latter.

We claim:

1. Washing device formed as an insertable unit on a printing machine having at least one cylinder with an outer cylinder surface, sand a printing machine frame, the washing device operating to clean the outer cylindrical surfaces of the cylinder, comprising a washcloth supply roll and a dirty-washcloth take-up roll for a washcloth, means for saturating the washcloth with washing medium, means for withdrawing the washcloth from said supply roll by winding it on said take-up roll, a pressure applicator having an inflatable membrane member, for pressing said washcloth against the cylinder, a feeder device disposed on the printing machine, disconnectable coupling means for coupling said take-up roll with the feeder device, a roll-sensing device fixed to the printing machine, means for automatically connecting the roll-sensing device with the washing device when the washing device is inserted into the printing machine, an upwardly exposed washcloth section, in the inserted position, said pressure applicator being disposed downstream of said upwardly exposed washcloth section, as viewed in transport direction of the washcloth, and a washing-medium dispenser device fixed to the printing machine and extending along an elongated side of the washing device being disposed above said washcloth section to dispense washing medium to said washcloth section.

2. Washing device according to claim 1, including a coupling claw in said connecting means, a side cover of the washing device, said coupling claw projecting from said side cover, and fastening means for fastening the washing device in its entirety in the machine frame, said fastening means including a guide, at least two fastening bolts located on the side cover of the washing device, said fastening bolts being spaced apart in direction of insertion of the washing device, a rail guide fixed tot he machine for receiving at least one of said fastening bolts said rail guide being closed on one side, latching means for latching said washing device in the inserted position.

3. Washing device according to claim 1, including a rigidly constructed front fastening bolt disposed in vicinity of said pressure applicator and a rear fastening latching bolt selectively movable between a locking position and an unlocking position.

4. Washing device according to claim 3 including a rail guide for receiving said washing device wherein said latching bolt is disposed outside said rail guide when the washing device is in its inserted position.

5. Washing device according to claim 2, wherein said coupling claw forms claw holding a fixture open in the direction of insertion and, including a form locking drive pin of said feeder device fixed to the machine disposed in said coupling claw, while the washing device is in the inserted condition.

6. Washing device according to claim 1, including a roll-sensing device, a proximity switch in said roll-sensing device for sensing said supply roll, said proximity switch disposed laterally on the printing machine in the vicinity of an end face of said supply roll, said proximity switch being operative to issue a "supply roll empty" signal.

7. Washing device according to claim 6, including a transmission shaft, wherein said roll-sensing device comprises a roll feeler, said roll feeler being connected to said transmission shaft.

8. Washing device according to claim 6, wherein said roll-sensing device comprises a roll feeler mounted in a spring-biased manner on the transmission shaft and being spring-biased in contact with the supply roll.

9. Washing device according to claim 7, including a machine frame side in said printing machine, wherein said transmission shaft comprises, at the machine-frame side, a contact cam, a swivel element cooperating with said contact cam, said swivel element being spring-biased against said contact cam, said proximity switch being responsive to said swivel element to issue a "supply roll empty" signal when the supply roll is empty.

10. Washing device according to claim 2, including a transmission shaft, and a sleeve extending through said side cover to rotatably mount said transmission shaft.

* * * * *